United States Patent [19]

Baumberger

[11] Patent Number: 4,700,772

[45] Date of Patent: Oct. 20, 1987

[54] HEAT EXCHANGER SYSTEM

[75] Inventor: Peter Baumberger, Winterthur, Switzerland

[73] Assignee: Sulzer Brothers Limited, Winterthur, Switzerland

[21] Appl. No.: 752,394

[22] Filed: Jul. 3, 1985

[30] Foreign Application Priority Data

Jul. 5, 1984 [CH] Switzerland ..... 3253/84

[51] Int. Cl.[4] ..... F28F 27/02

[52] U.S. Cl. ..... 165/103; 165/160; 122/32

[58] Field of Search ..... 165/103, 145, 160; 122/32

[56] References Cited

U.S. PATENT DOCUMENTS

| | | | |
|---|---|---|---|
| 3,433,298 | 3/1969 | Vollhardt | 165/160 X |
| 3,753,662 | 8/1973 | Pagani et al. | 165/103 X |
| 3,871,444 | 3/1975 | Houser et al. | 165/160 X |
| 3,991,821 | 11/1976 | Cook et al. | 165/103 |
| 4,047,506 | 9/1977 | Weber | 122/32 |
| 4,173,997 | 11/1979 | Andrews et al. | 122/32 X |
| 4,285,393 | 8/1981 | Maus et al. | 165/160 X |
| 4,494,484 | 1/1985 | Ruzek | 165/160 X |
| 4,498,524 | 2/1985 | Jacobsen | 165/103 X |
| 4,502,626 | 3/1985 | Gerstmann et al. | 165/160 X |

FOREIGN PATENT DOCUMENTS

| | | | |
|---|---|---|---|
| 2846455 | 10/1979 | Fed. Rep. of Germany | 165/103 |
| 1188371 | 4/1902 | France | 122/32 |

*Primary Examiner*—Albert W. Davis, Jr.
*Assistant Examiner*—Peggy Neils
*Attorney, Agent, or Firm*—Kenyon & Kenyon

[57] ABSTRACT

The heat exchanger system is provided with a second duct part in communication with and downstream of the mixing chamber as well as a helical tube heating surface in the second duct part for conveying a working medium in heat exchange with the hot gas. A pair of branch ducts extend upwardly from the first duct part for the hot gas with the centrally disposed branch duct serving as a bypass for the hot gas. A restrictor in the form of a valve is provided at the upper end of the central branch duct to control the flow of hot gas therefrom into a mixing chamber.

13 Claims, 3 Drawing Figures

HEAT EXCHANGER SYSTEM

This invention relates to a heat exchanger system. More particularly, this invention relates to a heat exchanger system for removing heat from a hot process gas.

Heretofore, various types of heat exchanger systems have been known for removing heat from a hot gas such as a process gas. For example, European Patent Application No. 0111615 describes a heat exchanger system which is comprised of a number of heat exchanger surfaces which are received in a single substantially cylindrical pressure vessel. In addition, a duct part is disposed in the pressure vessel to contain one of the heat exchanger surfaces while a pair of parallel branch ducts extend from the duct part into a common mixing chamber. Further, an evaporator heating surface is also disposed in one of the branch ducts as a second heat exchanger surface. Also, an adjustable restrictor is disposed in one of the branch ducts in order to control the gas flow. Such a heat exchanger system is of compact construction and is readily adjustable. However, the above type of system has limited usefulness. First, a predetermined proportion of the total quantity of heat must be supplied to the evaporator heating surface for reasons of control engineering. Second, for constructional reasons, the temperature of the hot gas near the junction from the duct part into the branch ducts is limited, for example to approximately 600° C. in the frequent cases in which the system is used to cool synthesis gas.

Accordingly, it is an object of the invention to improve the known heat exchanger systems.

It is another object of the invention to widen the range of use of a known heat exchanger system while substantially retaining the conventional good features of the system.

Briefly, the invention provides a heat exchanger system for removing heat from a hot gas which is comprised of a pressure vessel, a first duct part within the vessel for conveying a hot gas therethrough, a pair of parallel branch ducts communicating with the duct part in order to convey the hot gas therethrough and a common mixing chamber communicating with the branch ducts in order to receive the hot gas. In addition, a first evaporator heating surface is disposed in one of the branch ducts for conveying a working medium therethrough in heat exchange relation with the hot gas in the branch duct. Also, an adjustable restrictor is disposed in at least one of the branch ducts for controlling a flow of hot gas therethrough.

In accordance with the invention, a second duct part is disposed in the vessel in communication with and downstream of the mixing chamber for conveying the hot gas therethrough and a heat exchanger surface is disposed in the second duct part for conveying a working medium therethrough in heat exchange relation with the hot gas. The provisions of a second duct part in which a second heat exchanger surface is disposed facilitates the transmission of very substantial quantities of heat even without the need for the provision of a heat exchanger surface in the second branch duct. Hence, the second branch duct can, if required, serve simply as a hot gas bypass. The control range of the system is therefore increased considerably as compared with the known system.

Further, since a heat exchanger surface in the second branch duct can be of small dimensions or possibly completely omitted, the junction zone between the first duct part and the branch ducts does not have to be so resistant to high temperatures whereas the second heat exchanger surface in the second duct part is acted on only by gas which has been adequately cooled in the first branch duct at least along the entire evaporator heating surface.

Another advantage provided by the system is that the second branch duct need have only a relatively small heat exchange surface or, in some circumstances, no such surface at all. There are fewer restrictions on the construction of the second branch duct since the duct can be disposed even at the center of the pressure vessel. This serves to facilitate endeavors for the system to be of compact construction.

The system may be constructed so that the first duct part, at least one of the branch ducts and the second duct part are annular ducts which are coaxial of the pressure vessel. This leads to an optimal use of the space occupied by the heat exchanger system and therefore to a smaller and relatively light pressure vessel. This results in a lower cost, ready transportability and ready assembly of the system.

The system may also comprise a second evaporator in the first duct part which communicates with the evaporator in the branch duct in order to convey a common working medium. This permits a substantial increase in the temperature range with which the heat exchanger system can operate.

The first duct part and the first branch duct may also be disposed in axial alignment with each other. This provides constructional advantages because smooth partitions can be provided. This, in turn, facilitates easy dismounting of the very heavily stressed heating surfaces.

In order to provide a very compact construction, the second branch duct may be a cylindrical duct with a displacement member arranged centrally in the first duct part coaxial of the first branch duct.

Where the pressure vessel is disposed about a vertical axis, a plurality of single-coiled tube banks may be used to define the first and second evaporators. Further, each tube bank may be involute with arms parallel to the vertical axis of the vessel. This provides particular cost advantages since the pipe coils are very simple to produce and the suspension of such tube banks requires no special carrying or support means.

The heat exchanger surface in the second duct part may be formed of a helical tube heating surface. This permits a very high heat transfer and, in the event of a leak, the leaky pipes can be readily cut out of operation without leading to hot strands in the gas.

The restrictor may be in the form of a centrally disposed mushroom valve downstream of the cylindrical branch duct. This provides a simple and relatively small restrictor which is disposed in a relatively cool zone and which is simple to operate.

The pressure vessel may be provided with a coaxial hot gas entry at a bottom and at least one lateral gas outlet connection at the top. This provides constructional and operating advantages and underscores the advantages of the invention. In the known heat exchange system, the gas outlet connection has to be disposed in the bottom part of the pressure vessel so that the connections of all the heat exchanger surfaces to the medium-conveying lines must be disposed in the top part of the pressure vessel. However, with the present invention, at least the medium connections of the bottom heat exchanger surface are disposed in the bottom part of the pressure vessel. Hence, in the event of stoppage of the heat exchanger system, any solid or liquid residues of the medium may be simply removed from the other heat exchanger surface.

An annular chamber may also be disposed between the second duct part and a wall of the pressure vessel while communicating the second duct part with the gas outlet connection. This provides a simple means of protecting the pressure vessel wall against overheating.

A second adjustable restrictor may also be provided for selectively connecting the gas outlet connection with at least one of the duct parts and /or the branch ducts. This provides a simple means of controlling the final temperature of the gas.

The tube banks for the evaporator may also have arms of reduced diameter to define the second evaporator, that is, the evaporator in the first duct part. This has the advantage of reducing the temperature of the coiled tube banks. Also, a cross-flow of some of the gas is permitted in the junction region without a high pressure drop on the gas side. The coil tubes may also be spaced apart from one another by projections. This enables the coiled tubes to be packed together to form a compact ring bunch which can be readily suspended by way of the outermost tubes.

A cover may also be secured to the top of the pressure vessel with a layer of thermal insulation on the underside. The cover ensures ready accessibility to the interior of the pressure vessel and particularly to the heating surfaces while the insulation permits a relatively thin-walled cover to be used.

These and other objects and advantages of the invention will become more apparent from the following detailed description taken in conjunction with the accompanying drawings wherein.

Figure 1:
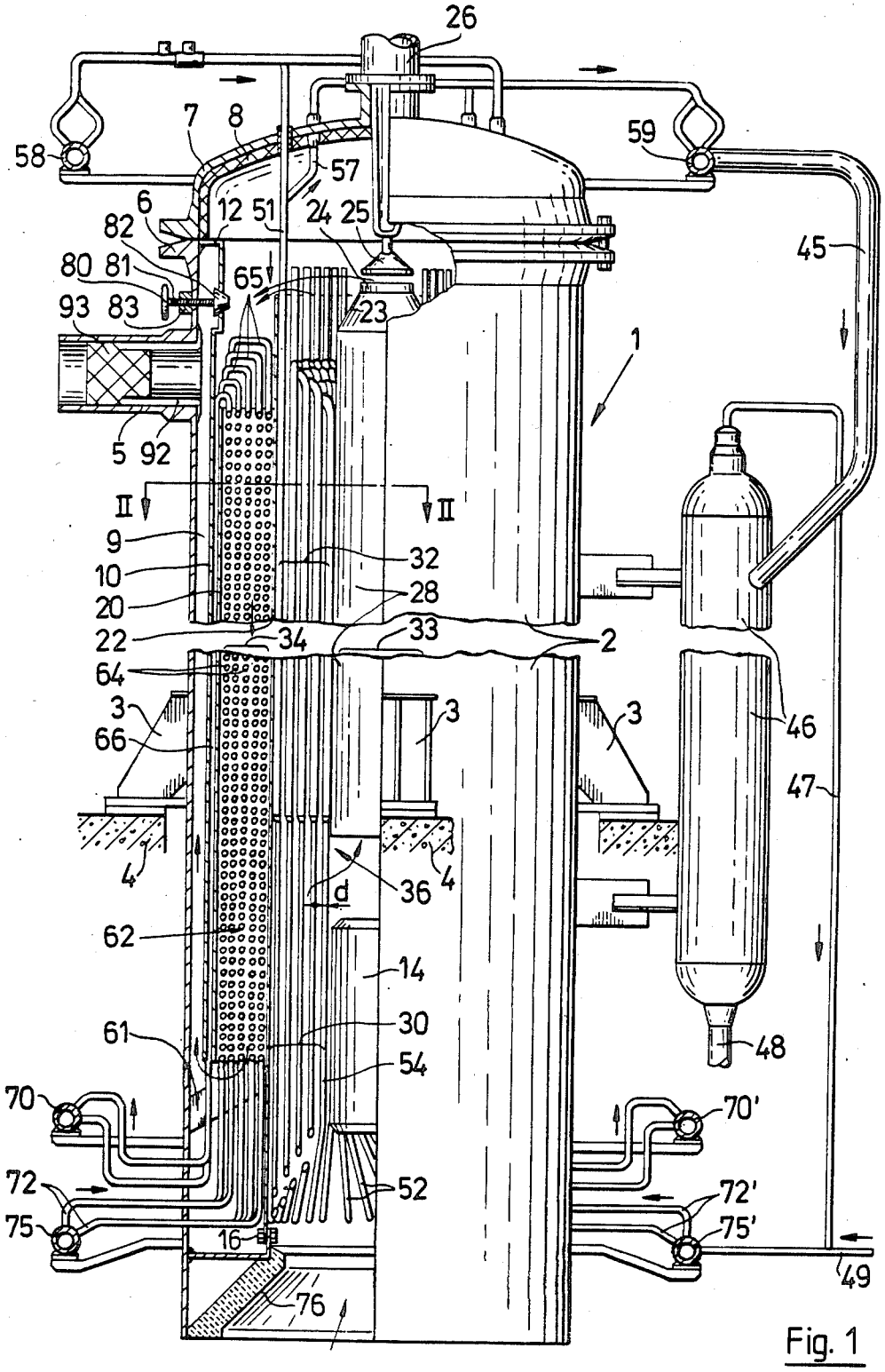
FIG. 1 illustrates a fragmented diagrammatic view in vertical section through a heat exchanger system constructed in accordance with the invention.

Referring to FIG. 1, the heat exchanger system is constructed to remove heat from a hot gas such as a process gas. As illustrated, the system includes a cylindrical pressure vessel 1 which has a tubular bottom part 2 which is carried by way of lug supports 3 on a foundation 4. The bottom part 2 has a coaxial hot gas entry at a bottom end which is connected to a suitable gas entry line (not shown). In addition, at least one lateral gas outlet 5 is provided at the top of the vessel 1 slightly below the top end of the part 2. As indicated, a flange 6 is provided at the top end of the part 2 and a cover 7 rests on the flange 6 to form a top part of the vessel 1. In addition, a layer of thermal insulation 8 is provided on the underside of the cover 7.

A lining 10 extends at a reduced distance from the inner wall of the vessel part 2 so as to bound an annular chamber 9. The lining 10 extends over a central extended zone of the part 2 and terminates at the top at an inside edge of an annular plate 12 to which the lining 10 is sealingly connected. The periphery of the plate 12 is also sealingly connected to the vessel part 2.

An outer duct wall 20 extends inside the lining 10 at a reduced radial distance to define an annular space therebetween. A middle duct wall 22 is also disposed inside the outer wall 20 and is connected at the bottom end by way of a seal-tight but readily releasable connection 16 to the wall of the vessel part 2. An inner duct wall 28 is provided inside duct wall 22 and cooperates therewith to bound a first branch duct 32 of annular cross-section. The wall 28 also bounds a cylindrical inner second branch duct 33 and carries a metal cone 23 having a valve seat 24 at the top end. An adjustable restrictor 25 in the form of a centrally disposed mushroom valve is provided above the valve seat 24 for controlling a flow of hot gas therethrough. As indicated, the restrictor 25 is actuated by a servomotor 26.

A displacement member 14 is disposed centrally within and in the bottom part of the wall 22 and cooperates with the wall 22 to bound a duct part 30. As indicated, the displacement member is coaxial of the duct part 30. In addition, a junction is disposed above the member 14 at which the two branch ducts 32, 33 start. As shown, the duct part 30 and the outer branch duct 32 are in alignment with one another.

Figure 2:
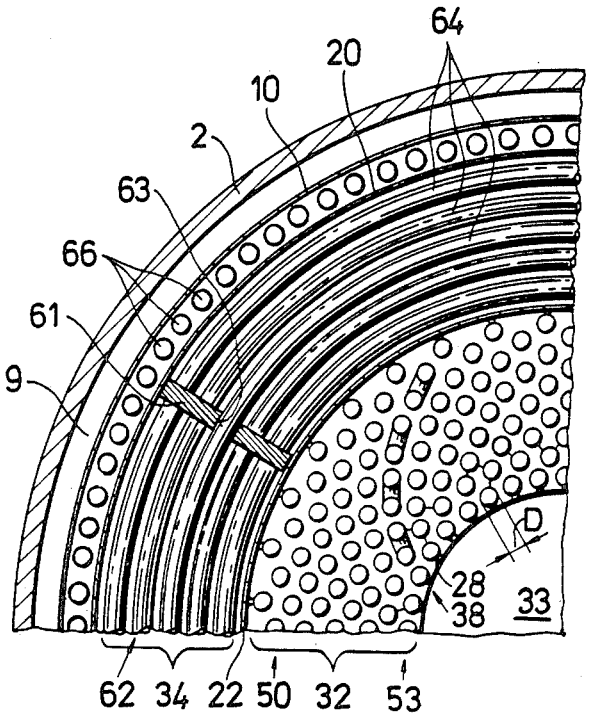
FIG. 2 illustrates a view to a larger scale than FIG. 1 of a section taken on line II—II of FIG. 1.

A heating surface 36 in the form of an evaporator extends over the whole height of the annular chamber formed by the duct part 30 and the first branch duct 32. The heating surface 36 is formed of thirty six involute single coiled tube banks 38 each of which is formed by a tube with vertical arms. A tube bank 28 is shown in developed form in FIG. 3 and is disposed as indicated in FIG. 2.

Figure 3:
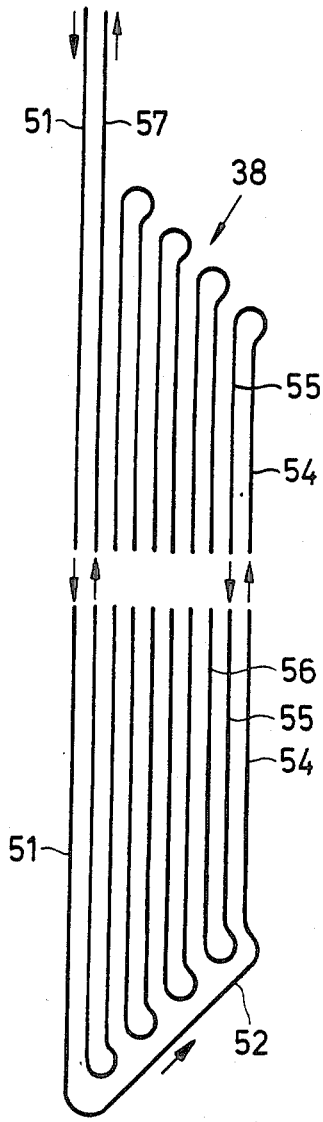
FIG. 3 illustrates a developed view of a coiled tube tank.

Each tube bank 38 has an inlet arm 51 which extends on an outermost tube cylinder 50 (see FIG. 3) and which is connected by way an inclined part 52 to an arm 54 which extends on an innermost tube cylinder 53 (see FIG. 3). The arm 54 is, in turn, connected at the top by way of a bend to an arm 55 which is connected at the bottom by way of a bend to another parallel arm 56. After multiple meandering of the tube, an outlet arm 57 finally extends vertically upwards and leads together with the arm 51 through the cover 7 by way of seal-tight tubes (see FIG. 1). The arms 51, 57, together with the corresponding arms of the other thirty five tube banks 38 are then connected to a distributor 58 and a header 59, respectively.

At about the height of the bottom end of the inner duct wall 28, all the arms of the tube banks 38 are reduced in diameter, i.e. of a reduced diameter d below this position and an increased diameter D above this position. Consequently, the flow velocity of the gas in the duct part 30 is reduced and the flow velocity of the medium to be evaporated is simultaneously increased. As a result, heat transfer is reduced on the outside of the tubes and increased on the inside, in both cases with the effect of lowering the temperature of the tube material. Because of the reduced tube diameter, the flow cross-section for the partial gas flow passing from the duct part 30 to the second branch duct 33 is increased.

Inside and between the banks 38 the tube arms are spaced apart from one another either by projections (not shown) disposed on the arms or by peripheral ribs or fins or the like disposed at various heights. To produce the surface 36 the banks 38 are layered on the inner duct wall 28, bent into involute surfaces and pressed together radially by means of clamping bands (not shown) which extend over the periphery of the surface 36. The resulting heating surface bunch is encased in wire braiding near the first branch duct 32. Near the duct part 30 the outermost arms 51 can engage the central duct wall 22, the same thus being cooled in operation. Here too, however, wire braiding, possibly in a number of layers, made of a highly heat resistant material can be provided or an insulation can be provided which reduces heat transfer to the central duct wall 22.

The annular chamber bounded by the outer duct wall 20 and middle duct wall 22 forms a second duct part 34 in which a second heat exchanger surface 62—a superheating surface in this case—is disposed. This surface 62 is embodied by twenty-nine helically extending tubes 64 which form five tube cylinders. At their bottom end, the tubes 64 are connected to distributors 75, 75' by way of connecting tubes 72, 72' which extend through the wall of the part 2 of the vessel 1. At the top end, each tube 64 is connected by way of a tube bend 65 to one of twenty-nine fallers 66 which extend vertically in the annular duct between the lining 10 and the outer duct wall 20. The fallers 66 issue from the annular duct by way of a substantially gas-tight lead-through (not shown) and issue laterally from the pressure vessel 1 through the wall of the part 2 in thermosleeves. The fallers 66 are connected to two headers 70, 70'. As such, the surface 62 is free to expand upwardly.

The tubes 64 of the surface 62 are retained in perforate support plates 61 disposed inside the second duct part 34 in three planes which are offset from one another and which extend through the vertical axis of the vessel 1. The bottom ends of the plates 61 are secured laterally to the wall of the part 2 and the support plates 61 are formed over the height of the surface 62 with bores 63 as shown in FIG. 2. The tubes 64 extend sinuously in the bores 63 and, the plates 61 are free to expand upwardly.

An adjustable restrictor in the form of a valve comprising a handwheel 80, a horizontal valve rod 81 and a cone 82 operative in a circular aperture in the lining 10 is disposed above the gas outlet connection 5 on the vessel part 2. The wheel 80 is outside the vessel 1 and, the rod 81 extends through the wall of the vessel part 2. A screwthread (not shown) on the rod 81 is engaged in a nut 83 secured to the vessel part 2 and the place where the rod 81 extends through the bottom part 2 is sealed in known manner. This restriction serves to selectively connect the gas outlet 5 with the second duct part 34.

The gas outlet connection 5 is lined with a lining plate 92 which forms an inlet nozzle and which extends into a static mixer 93.

Below the coiled heating surface 36, the connection 16 and the lowest part of the part 2 are protected against overheating by masonry 76 which can comprise cooling tubes (not shown).

The header 59 is connected by way of a wet steam line 45 to a separator 46 whose steam outlet line 47 extends to the distributors 75, 75' while separated water discharges through a discharge connection 48 at the base of the separator 46. Also connected to the distributors 75, 75' is another steam supply line 49 coming, for instance, from coolers or from a boiler installation.

The heat exchanger system shown in FIGS. 1–3 operates as follows:

A process gas at a temperature of, for example, 1000° C. and at a pressure of from 20 to 40 bar is supplied to the bottom end of the vessel 1. This gas flows through the duct part 30 and then, after cooling to approximately 900° C., is distributed through the first branch duct 32 and second branch duct 33. The partial flow in the duct 32 yields further heat and is cooled, for example, to 600° C.

The two partial or component flows rejoin one another in a mixing chamber above the wall 28 and the first branch duct 32 at a mixing temperature of, for example, 700° C. The combined gas flow then passes downwardly into the second duct part 34, and is further cooled, for example, to 400° C. The gas then passes upwardly through the annular chamber 9 to cool the wall of the pressure vessel 1, into the annular chamber below the plate 12 and thence through the gas outlet connection 5 for further use.

When the temperature of the gas at the exit from the vessel 1 is too low, hot gas is supplied thereto from the mixing chamber by opening the valve cone 82. The quantity of this supply can be controlled by turning the rod 81 by means of the wheel 80.

In order that any hot gas streaks produced by the opening of the valve cone 82 do not produce hot spots on the wall of the part 2 and on the gas outlet connection 5, the lining plate 92, with or without the assistance of additional deflectors, keeps such streaks away from the pressure-bearing wall. The static mixer 93 then equalizes the gas temperature.

The heat exchanger system is supplied by way of the distributor 58 with a secondary medium in the form of preheated water injected into the surface 36 through the arms 51. As previously stated, the surface 36 serves as an evaporator, and so the mixture of steam and water flows through the arms 57 into the header 59. The mixture is then separated in the separator 46, water discharging through the connection 48 while wet steam is injected through the line 47 into the distributors 75, 75'.

Further wet steam from the plant (not shown) can be injected into the distributors 75, 75' through the line 49. The wet steam passes through the fallers or connecting tubes 72, 72' into the second heat exchanger surface 62 and is superheated therein in countercurrent to the heating gas. The superheated steam leaves the heat exchanger through the tubes 66 and headers 70, 70'.

To allow for possible soiling, the heating surfaces in the duct part 30 and in the first branch duct 32 are large enough for operations to begin with the restrictor 25 and cone 82 fully open. Considerable heat is evolved in the duct part 30 in these circumstances and a very large proporation of the gas leaving the part 30 goes through the second branch duct 33, hence the quantity of heat evolved in the first branch duct 32 stays relatively smaller. Since the gas entry temperature in the second branch duct 33 is already fairly low, there is no risk of the duct 33 overheating. Correspondingly, the gas temperature downstream of the second duct part 34 is relatively low. The temperature of the gas issuing from the pressure vessel 1 can be restored to the required level by the injection of a relatively large quantity of hot gas through the fully open valve cone 82.

Soiling of the surface 36 reduces its heat uptake. This reduction can be corrected by reducing the opening cross-section of the restrictor 25. Since the second heat exchanger surface 62 is also substantially over-dimensioned, there is little risk in these circumstances of the required superheat temperatures of the steam not being reached.

Since soiling of the heat exchanger surface 62 increases the temperature of the gas in the annular chamber 9 beyond what it would be if the heating surfaces were clean, closing the valve cone 82 restricts the supply of hot gas to the annular chamber below the plate 12.

When the heating surfaces have become so soiled that the restrictor 25 must be fully closed and it becomes impossible to keep to the required temperatures, the cover 7 is lifted off to enable the heating surfaces to be cleaned, the heating surfaces 36 and the inner duct wall 28 also being withdrawn. After the connection 16 has been released, the central duct wall 22 can then also be withdrawn fairly easily.

After removal of the clamping means around the surface 36, particularly in the central and bottom part thereof, the tube banks 38 can readily be bent outwards for cleaning. The surface 62 can be inspected from the inside and cleaned from the inside.

Should the junction be too low or too high due to design, it is a simple matter to shorten the inner duct wall 28 or extend the wall 28 downwardly. Another possibility is to make the junction adjustable, for example, by one or two sleeve valves or by a bypass in the wall 28.

The invention is not limited to the embodiment shown. For instance, it may be advantageous for the duct walls 20, 22, 28 to be devised at least to some extent as diaphragm walls—i.e., as walls of welded tubes.

The heat exchanger surfaces of the embodiment are shown in a very simple form. They can, however, be subdivided. The flow directions can also be wholly or partly reversed.

More than one secondary medium can participate in the heat exchange. If it is required to obviate restrictors in the pressure vessel, the restrictors can be placed in connecting lines serving to convey gas outside the pressure vessel.

To distribute heat exchange among various heating surfaces, it may in some circumstances be possible to vary the quantity distribution of the or each secondary medium. The type of heat exchanger surfaces may also be, for instance, blind tubes or heat tubes.

The branching into branch ducts can be staggered at various temperatures or for various temperature ranges. The recombination of the branch flows can be staggered. The opening controlled by the valve cone 82 can also be connected on the inlet side to places in either branch duct. Depending upon the margin conditions set, the arrangement of the ducts in the pressure vessel may be changed over or arranged in any other way. To facilitate the blanking-off of individual tubes, particularly in the superheater bunch, it may be expedient to connect, for instance, the connecting tubes 72 in accordance with Swiss Patent No. 384 602 to tube plates.

To facilitate dismantling of the surface 62, the part 2 of the pressure vessel 1 may be subdivided below the securing place of the plates 61 by horizontal intermediate flanges.

To increase the operating safety of the system, redundancies can be provided. For example, two or more valve cones 82 and the components associated therewith can be provided.

The invention thus provides an improved heat exchanger system for removing heat from a hot process gas.

The invention further provides a means of modifying existing heat exchanger systems in a relatively simple manner for improved operation.

What is claimed is:

1. A heat exchanger system for removing heat from a hot gas comprising a pressure vessel;

a first duct part within said vessel for conveying a hot gas therethrough;

a centrally disposed displacement member coaxial of said duct part;

a pair of parallel branch ducts communicating with said first duct part to convey the hot gas therethrough, one of said branch ducts being in axial alignment with said first duct part and the other branch duct being cylindrical and coaxial with said displacement member;

a common mixing chamber communicating with said branch ducts to receive hot gas therefrom;

a first evaporation heating surface disposed in said first duct part and said one branch duct for conveying a working medium therethrough in heat exchange relation with the hot gas in said first duct part and said one branch duct;

an adjustable restrictor in at least one of said branch ducts for controlling a flow of hot gas therethrough;

a second duct part disposed in said vessel in communication with and downstream of said mixing chamber for conveying the hot gas therethrough;

a heat exchanger surface in said second duct part for conveying a working medium therethrough in heat exchange relation with the hot gas;

at least one lateral gas outlet communication in said pressure vessel; and an annular chamber between said second duct part and said pressure vessel, said annular chamber communicating with said second duct part and said gas outlet connection.

2. A heat exchanger system as set forth in claim 1 wherein said pressure vessel is cylindrical and at least one of said branch ducts and said second duct part are annular and coaxial of said vessel.

3. A heat exchanger system as set forth in claim 1 wherein said pressure vessel is disposed about a vertical axis with a plurality of single-coiled tube banks defining said first evaporation heating surface, each tube bank being involute with arms parallel to said axis.

4. A heat exchanger system as set forth in claim 3 wherein said heat exchanger surface is a helical tube heating surface.

5. A heat exchanger system as set forth in claim 3 wherein each tube bank is disposed in said first duct part and extends through said one branch duct with said arms being of reduced diameter within said first duct part.

6. A heat exchanger system as set forth in claim 3 which further comprises tubes passing through said pressure vessel to suspend said tube banks therefrom and to convey a working medium therebetween.

7. A heat exchanger system as set forth in claim 1 wherein said restrictor is a centrally disposed mushroom valve disposed downstream of said cylindrical branch duct.

8. A heat exchanger system as set forth in claim 1 wherein said pressure vessel has a coaxial hot gas entry at a bottom and said lateral gas outlet is at a top thereof.

9. A heat exchanger as set forth in claim 8 further comprising a second adjustable restrictor for selectively connecting said gas outlet connection with at least one of said duct parts and said branch ducts.

10. A heat exchanger system as set forth in any one of claims 3 5 and 6 which further comprises a cover secured to a top of said pressure vessel and a layer of thermal insulation on an underside of said cover.

11. A heat exchanger system for removing heat from a hot gas comprising a pressure vessel;

a first duct part within said vessel for conveying a hot gas therethrough;

a pair of parallel branch ducts communicating with said first duct to convey the hot gas therethrough;

a common mixing chamber communicating with said branch ducts at downstream ends thereof to receive hot gas therefrom;

a first evaporation heating surface disposed in said first duct part and extending through one of said branch ducts for conveying a working medium therethrough in heat exchange relation with the hot gas in said duct part and said one branch duct;

an adjustable restrictor in the other of said branch ducts for controlling unimpeded flow of hot gas therethrough in non-heat exchange relation;

a second duct part disposed in said vessel concentrically of said first duct part and in communication with and downstream of said mixing chamber for conveying the hot gas therethrough;

an annular chamber between said second duct part and a wall of said pressure vessel, said annular chamber communicating with said second duct part to receive a flow of gas therefrom; and at least one lateral gas outlet connection in said wall in communication with said annular chamber to exhaust the gas.

12. A heat exchanger system as set forth in claim 11 further comprising a second adjustable restrictor for selectively connecting said gas outlet connection with said second part.

13. A heat exchanger system as set forth in claim 11 wherein said pressure vessel is disposed about a vertical axis with a plurality of single-coiled tube banks defining said first evaporation heating surface, each tube bank being involute with arms parallel to said axis and of reduced diameter within said first duct part.

* * * * *

UNITED STATES PATENT AND TRADEMARK OFFICE

CERTIFICATE OF CORRECTION

PATENT NO. : 4,700,772

DATED : October 20, 1987

INVENTOR(S) : PETER BAUMBERGER

It is certified that error appears in the above-identified patent and that said Letters Patent is hereby corrected as shown below:

Column 1, lines 10 and 11 change "European ... 011161" to -U.S. Patent 4,494,484

Column 4, line 34 change "Fig. 3" to -Fig. 2-

Column 8, line 27 change "communication" to -connection-

Column 8, line 60 change "outlet is" to -outlet connection is-

Column 9, line 17 change "controlling unimpeded" to -controlling an unimpeded-

Signed and Sealed this

Twenty-fourth Day of May, 1988

*Attest:*

*Attesting Officer*

DONALD J. QUIGG

*Commissioner of Patents and Trademarks*